United States Patent [19]

Rockwell et al.

[11] 3,972,253

[45] Aug. 3, 1976

[54] MULTI-SIZE SOCKET WRENCH

[75] Inventors: Philip K. Rockwell, Ventura, Calif.; Glenn L. Liffick, Richland, Wash.

[73] Assignee: The United States of America as represented by the Secretary of the Navy, Washington, D.C.

[22] Filed: Oct. 3, 1975

[21] Appl. No.: 619,283

[52] U.S. Cl. ..... 81/91 C; 81/99

[51] Int. Cl.[2] ..... B25B 13/32

[58] Field of Search..... 81/91 A, 91 C, 99, 111

[56] References Cited

UNITED STATES PATENTS

| | | | |
|---|---|---|---|
| 1,541,225 | 6/1925 | Kaough | 81/91 C |
| 1,974,105 | 9/1934 | Eagan | 81/91 C |
| 2,618,996 | 11/1952 | Logan | 81/111 |

FOREIGN PATENTS OR APPLICATIONS

| | | | |
|---|---|---|---|
| 365,348 | 12/1962 | Switzerland | 81/111 |

*Primary Examiner*—Al Lawrence Smith
*Assistant Examiner*—James G. Smith
*Attorney, Agent, or Firm*—Richard S. Sciascia; Joseph M. St.Amand; Darrell E. Hollis

[57] ABSTRACT

A multi-size socket wrench utilizing a jaw plate with at least one jaw member rotatably attached thereto. The jaw plate and the jaw member have diametrically opposed toothed sections thereon. A driving strut rotates about a shaft attached to the jaw plate. When rotated, the driving strut engages the jaw member rotating the jaw member with respect to the jaw plate, thereby closing the tooth section of the jaw member upon a bolt disposed adjacent the toothed section of the jaw plate.

6 Claims, 4 Drawing Figures

MULTI-SIZE SOCKET WRENCH

BACKGROUND OF THE INVENTION

1. Field of the Invention

This invention relates generally to wrenches and more particularly to multi-size socket wrenches.

2. Description of the Prior Art

Prior art devices available for tightening or loosening a variety of nut, bolt and stud sizes include crescent wrenches, nested hex-drives or an assemblage of wrenches or sockets. None of these devices can be used effectively by mechanical arms or other remote-controlled methods. Crescent and other related wrenches require human dexterity in their operations. Nested socket drives are too weak to be used by power wrenches and, if made strong enough, the sockets must skip nut and bolt sizes. In addition, an assemblage of sockets require remote socket exchange which is difficult and time consuming.

SUMMARY OF THE INVENTION

In order to overcome these problems, one embodiment of the present invention provides a multi-size socket wrench capable of automatically closing and grasping different sizes of nuts, bolts, studs, etc., utilizing a jaw plate with at least one jaw member rotatably attached thereto. The jaw plate and the jaw member have diametrically opposed tooth sections thereon. A driving strut rotates about a shaft attached to the jaw plate. When rotated, the driving strut engages the jaw member, rotating the jaw member with respect to the jaw plate, thereby closing the tooth section of the jaw member upon a bolt disposed adjacent the tooth section of the jaw plate. A spring connected between the jaw member and the jaw plate disengages the jaw member from the bolt when the driving strut is not engaging the jaw member.

Accordingly, one object of the present invention is to provide a multi-size socket wrench.

Another object of the present invention is to increase efficiency.

Another object of the present invention is to reduce cost.

One other object of the present invention is to increase flexibility.

Other objects and a more complete appreciation of the present invention and its many attendant advantages will develop as the same becomes better understood by reference to the following detailed description when considered in connection with the accompanying drawings in which like reference numerals designate like parts throughout the figures thereof and wherein.

DETAILED DESCRIPTION OF THE PREFERRED EMBODIMENT

Figure 1:
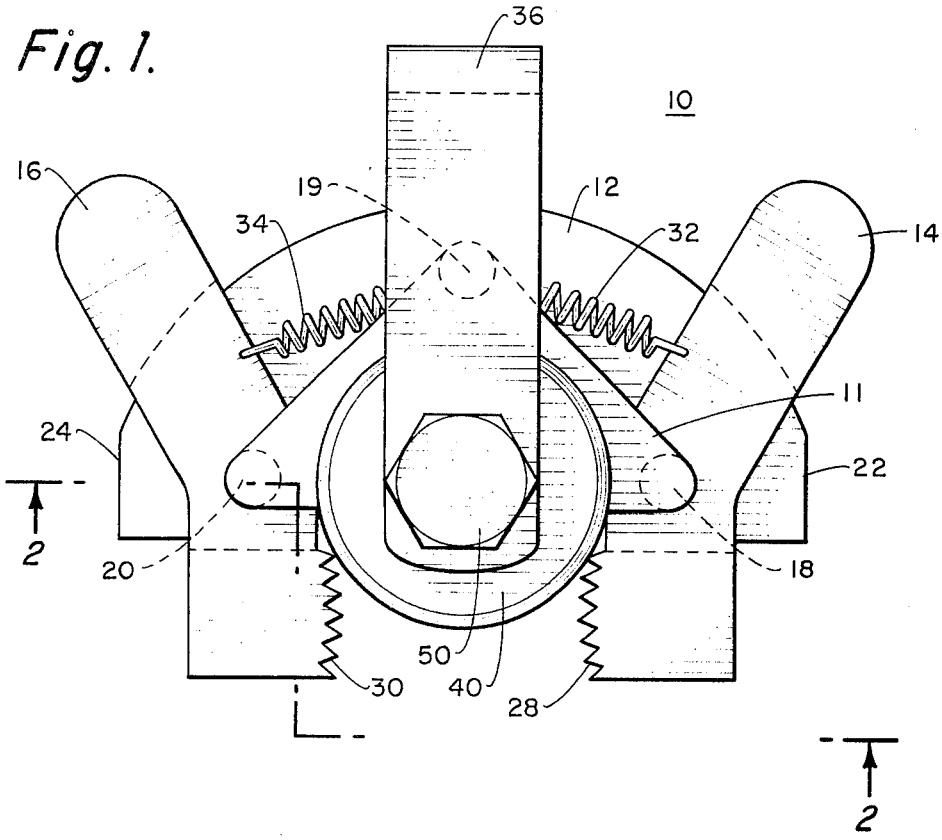
FIG. 1 is a top view illustrating the jaw plate and the rotatable jaw members.

FIG. 1 illustrates a top view of multi-size socket 10. Jaw members 14 and 16 are rotatably connected to jaw plate 12 at points 18 and 20, respectively. As more descriptively shown in FIG. 4, jaw plate 12 is U-shaped. Pivot or rotation points 18 and 20 about which jaw members 14 and 16 rotate are located near ends 22 and 24, respectively, of jaw plate 12.

Tooth section 26 is attached to jaw plate 12. Tooth sections 28 and 30 are attached to jaw members 14 and 16, respectively.

Springs 32 and 34 are connected between jaw plate 12 and jaw members 14 and 16, respectively. Springs 32 and 34 bias jaw members 14 and 16, respectively, in the positions shown in FIG. 1. Springs 32 and 34 are shown connected to point 19 in FIG. 4. Point 19 is located on jaw plate 12.

Figure 3:
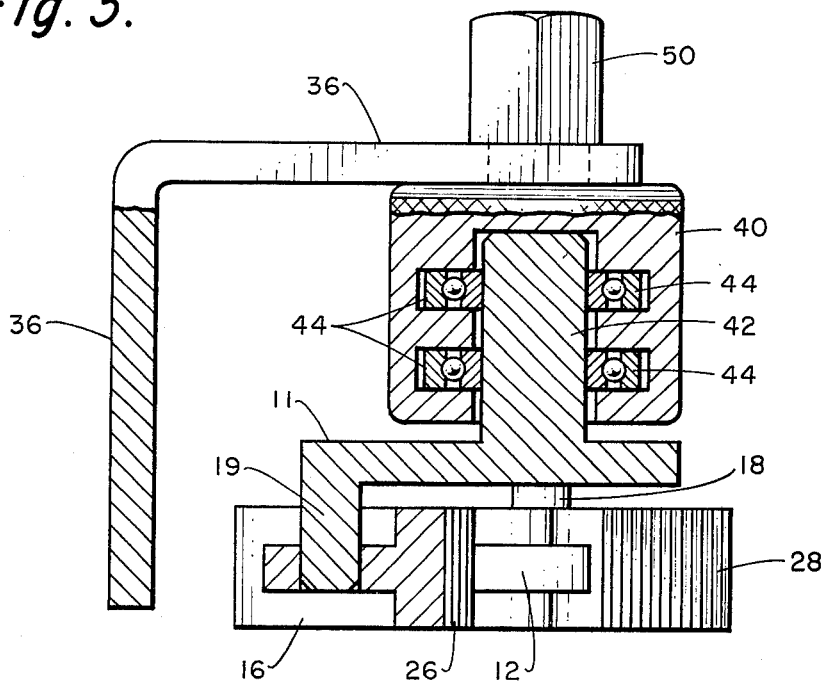
FIG. 3 is a cross-sectional view taken along line 3—3 of FIG. 2.

FIG. 3 illustrates driving strut 36 and related mechanism. Driving strut 36 is connected to housing 40. Housing 40 rotates about shaft 42 upon bearings 44. Shaft 42 is rigidly affixed to jaw plate 12. Driving strut 36 is rigidly affixed to housing 40 by hex drive 50. It is noted that driving strut 36 may consist of arm attachments to serve as levers in order to transmit more torque to bolt 52, as will be explained supra. In addition, multi-size socket 10 may be attached to a power wrench (not shown) either directly or remotely via hex drive 50.

Figure 2:
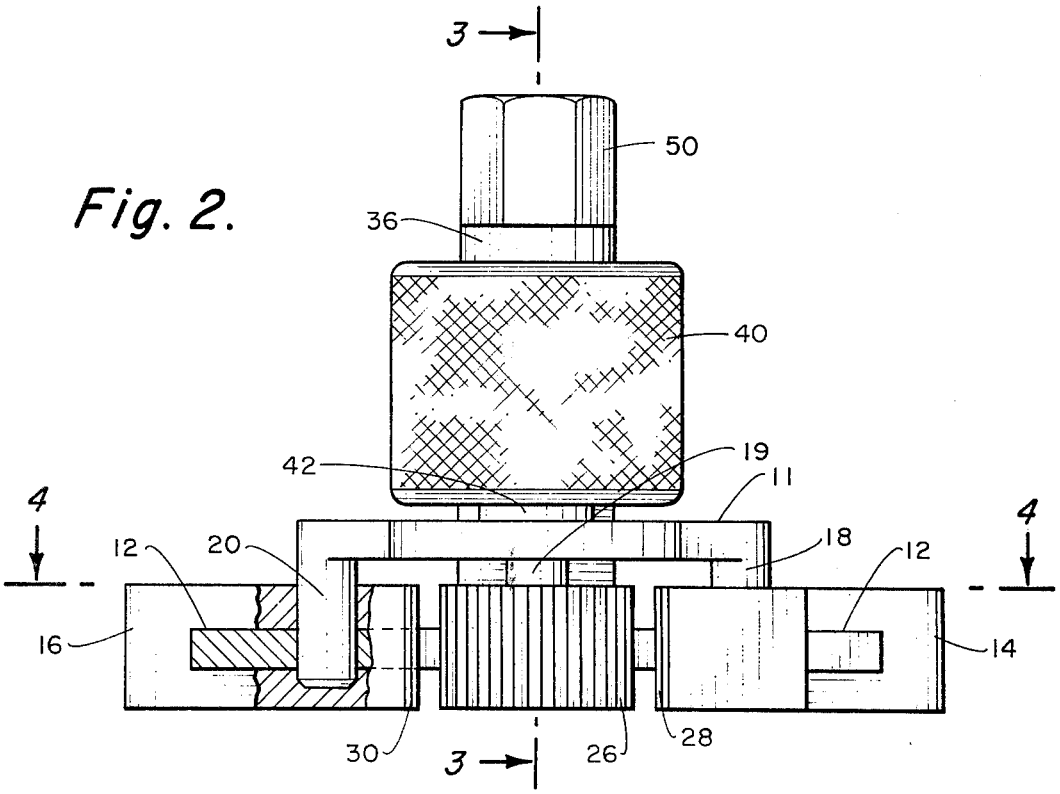
FIG. 2 is a side elevation of the present invention.

As is illustrated in FIGS. 1 and 2, tooth sections 28 and 30 are diametrically opposed to tooth section 26. The operation of multi-size socket 10 can best be illustrated by turning to FIG. 4. Driving strut 36 can either be rotated clockwise or counter-clockwise to engage and rotate either jaw member 14 or jaw member 16.

Figure 4:
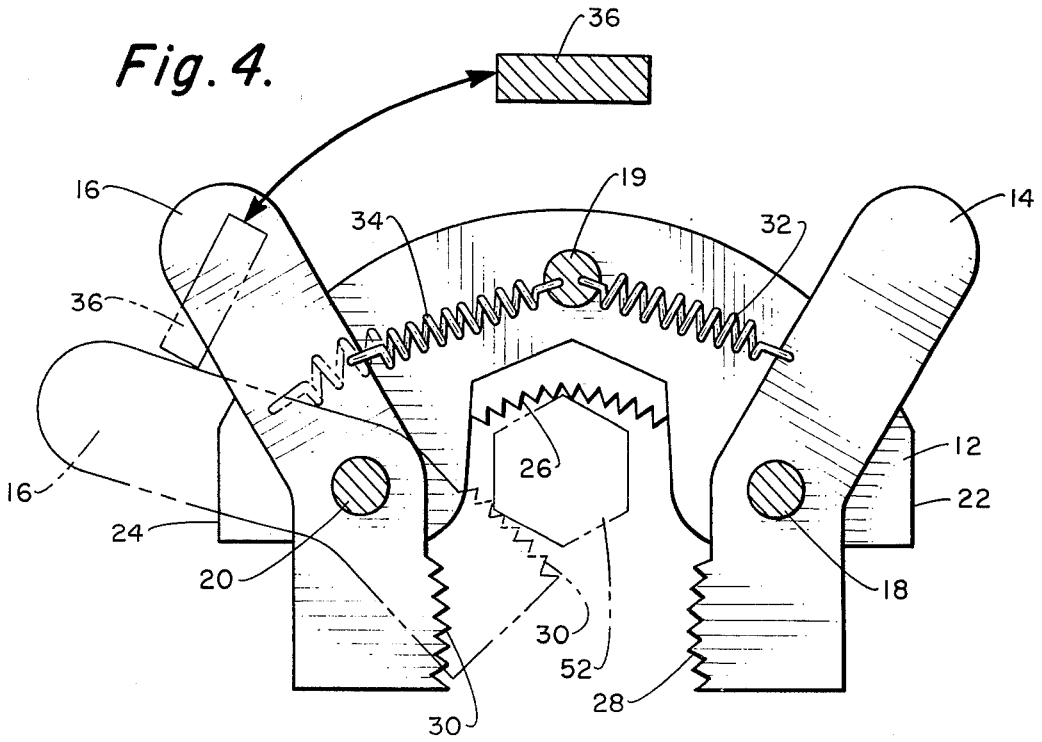
FIG. 4 is a cross-sectional view of the embodiment of FIG. 2 taken along line 4—4.

FIG. 4 illustrates a counter-clockwise rotation of driving strut 36. A bolt 52 is disposed adjacent tooth section 26 of U-shaped plate 12. Driving strut 36 is then rotated counter-clockwise and engages jaw member 16. Further rotation of driving strut 36 forces jaw member 16 to rotate about point 20 until tooth section 30 comes in contact with bolt 52. At this point, neither driving strut 36 nor jaw member 16 can rotate with respect to jaw plate 12. Driving strut 36 now serves as a lever to transmit torque to bolt 52 via jaw member 16 and jaw plate 12. This torque serves to either tighten or loosen bolt 52.

As shown in FIGS. 1 and 4, multi-size socket 10 exerts a torque on bolt 52 substantially parallel to the longitudinal axis of bolt 52. Multi-size socket 10 automatically centers itself with respect to bolt 52 and compliance between jaw plate 12 and housing 40 eliminates any need for a spacing bar and gripping lug.

It is noted from FIG. 2 that multi-size socket 10 is capable of grasping a bolt head with limited access, i.e., a bolt with only its head projecting above a plate into which the bolt is screwed. In addition, multi-size socket 10 has the capability of extracting both, having limited lateral access.

Multi-size socket 10 may be utilized to extract threaded studs as well as nuts and bolts of varying sizes.

Multi-size socket 10 may be utilized in an undersea environment as well as on land. In addition, multi-size socket 10 may be operated by hand, by a mechanical arm, or by other remote-controlled or automatic means.

In FIG. 4, when driving strut 36 is rotated counter-clockwise, multi-size socket 10 tends to loosen bolt 52. When driving strut 36 is rotated clockwise, multi-size socket 10 tends to tighten bolt 52.

Shaft plate 11 is rigidly affixed between jaw plate 12 and shaft 42. Shaft plate 11 is connected to jaw plate 12 at points 18, 19 and 20.

Obviously numerous modifications and variations of the present invention are possible in light of the above teachings. It is therefore to be understood that within the scope of the appended claims the invention may be practiced otherwise than as specifically described.

What is claimed is:

1. A multi-size socket wrench comprising:

a. a U-shaped jaw plate having a toothed section adapted to receive a bolt;

b. first and second jaw members having respective first and second toothed sections thereon and respective first and second lever portions, said first and second jaw members being rotatably connected to said U-shaped jaw plate at respective first and second pivot points, said first and second pivot points being respectively disposed between said first and second toothed sections and said first and second lever portions, when said first and second jaw members are rotated said respective first and second toothed sections contact said bolt such that said bolt is sandwiched between said jaw plate toothed section and said jaw member toothed section;

c. means rotatably connected to said jaw plate and disposed to contact said first lever portion when rotated clockwise and said second lever portion when rotated counter-clockwise for forcibly rotating one said jaw member with respect to said jaw plate such that said rotated jaw member toothed section contacts said bolt, thereafter said means increases the pressure exerted on said bolt between said jaw plate toothed section and said rotated jaw member toothed section such that said bolt is rendered immovable with respect to said jaw plate toothed section and said rotated jaw member toothed section, said jaw member rotating means also serving to transmit a torque to said bolt through said jaw plate and said jaw member substantially about said bolt's longitudinal axis.

2. The apparatus of claim 1 further comprising first and second means respectively connected between said first and second jaw members and said jaw plate for respectively disengaging said first and second jaw members toothed section from said bolt when said jaw member rotating means is not in contact with said first and second jaw members, thereby facilitating the removal of said bolt from between said first and second jaw members toothed section and said jaw plate toothed section.

3. The apparatus of claim 2 wherein said disengaging means further comprises respective first and second springs.

4. The apparatus of claim 1 wherein said jaw member rotating means comprises:

a. a shaft attached to said jaw plate;

b. a housing rotatable about said shaft; and c. a driving strut affixed to said housing and disposed to engage said first and second jaw members when said housing and driving strut rotate about said shaft.

5. The apparatus of claim 4 wherein the longitudinal axis of said shaft is disposed substantially parallel to the longitudinal axis of said bolt and said shaft is disposed above said bolt.

6. The apparatus of claim 4 further comprising a hex drive located between said housing and said driving strut.

* * * * *